United States Patent [19]

Cooper et al.

[11] Patent Number: 4,494,666

[45] Date of Patent: Jan. 22, 1985

[54] PRESSURE CONTAINMENT VESSEL APPARATUS FOR LEAKING GAS CYLINDER

[76] Inventors: Newell J. Cooper, 14023 N. Medinan Dr., Phoenix, Ariz. 85022; N. Jeffrey Cooper, 4424 W. Paradise La., Phoenix, Ariz. 85023

[21] Appl. No.: 550,367

[22] Filed: Nov. 10, 1983

[51] Int. Cl.[3] ..... B65D 45/00

[52] U.S. Cl. ..... 220/3; 220/327

[58] Field of Search ..... 220/3, 327, 328, 5 A, 220/325; 292/DIG. 2, 256.71, 256.73

[56] References Cited

U.S. PATENT DOCUMENTS

| | | | |
|---|---|---|---|
| 946,654 | 1/1910 | Clark et al. | 220/325 X |
| 982,848 | 1/1911 | Niebling | 220/328 X |
| 1,894,652 | 1/1933 | Willoughby | 220/323 |
| 2,288,919 | 7/1942 | Parsons | 220/327 |
| 3,197,061 | 7/1965 | Graves | 220/327 |
| 4,032,030 | 6/1977 | Bass et al. | 220/3.8 |
| 4,135,640 | 1/1979 | MacQuilkin et al. | 220/327 X |
| 4,233,697 | 11/1980 | Cornwall | 220/327 X |

FOREIGN PATENT DOCUMENTS

| | | | |
|---|---|---|---|
| 223335 | 10/1924 | United Kingdom | 220/325 |

*Primary Examiner*—Stephen Marcus
*Assistant Examiner*—Robert Petrik
*Attorney, Agent, or Firm*—H. Gordon Shields

[57] ABSTRACT

Pressure containment vessel apparatus includes a cylinder which receives a leaking gas cylinder and which includes an outwardly extending flange for receiving a dome. The dome includes a valve for venting the gas which leaks out of the leaking interior gas cylinder and locking elements which mate with fasteners on the outwardly extending flange to secure the top dome onto the cylinder.

10 Claims, 6 Drawing Figures

FIG. 1
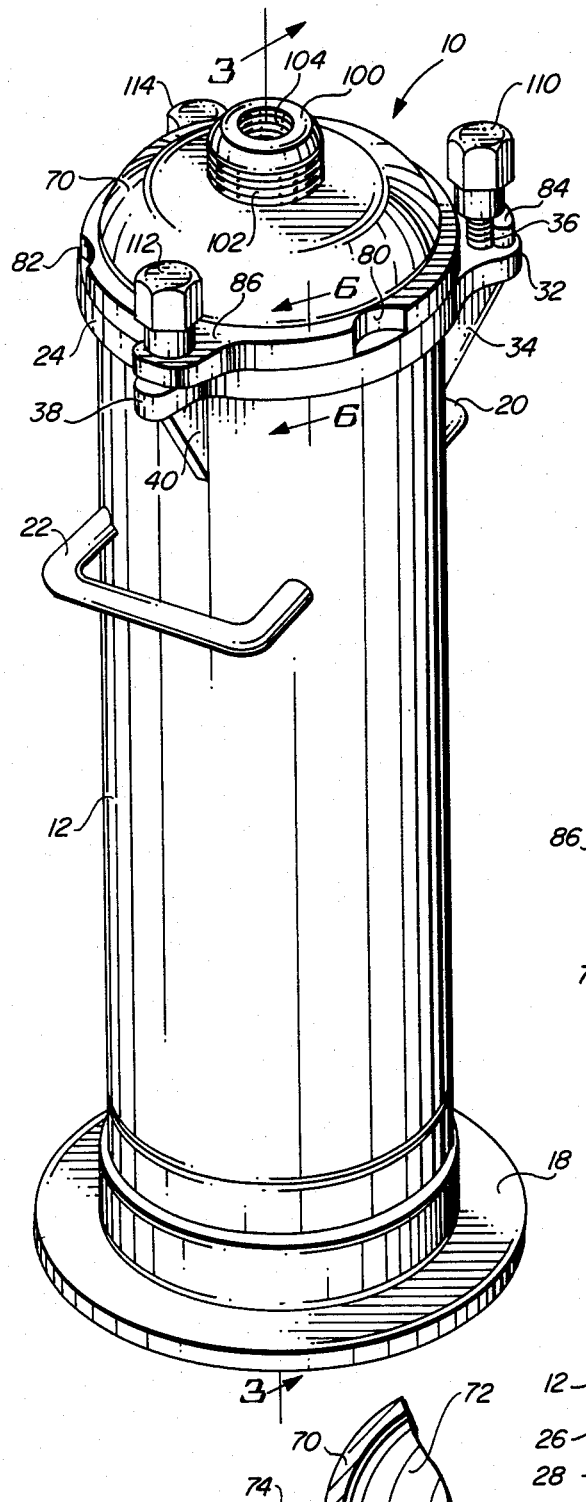
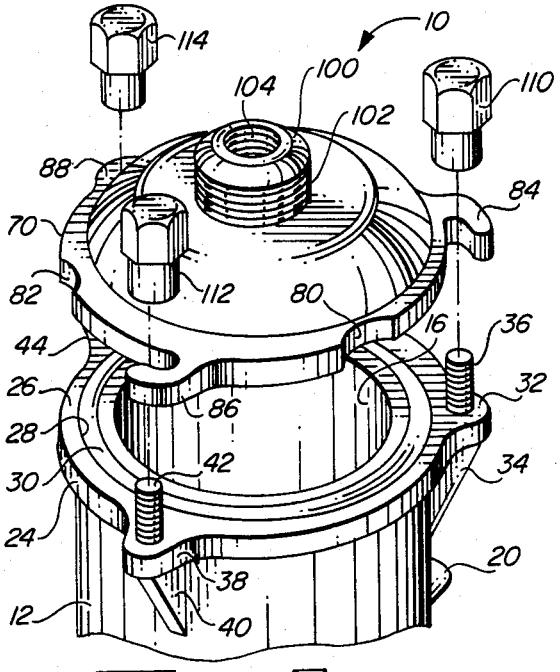
FIG. 2
FIG. 4
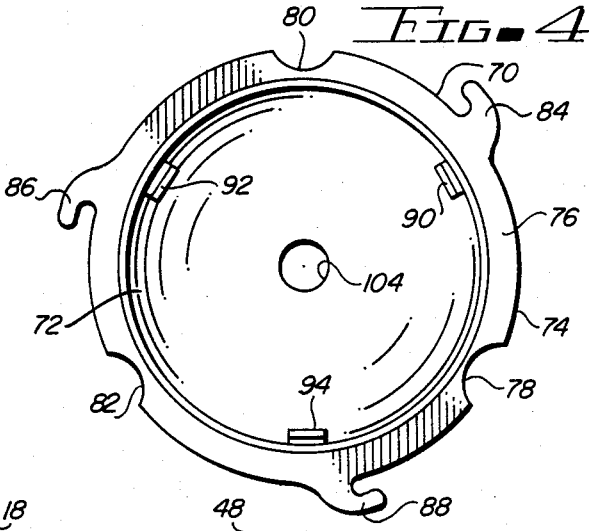
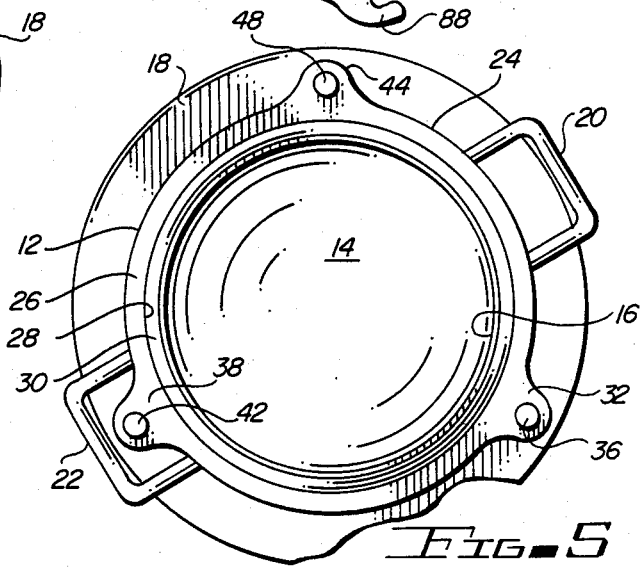
FIG. 5
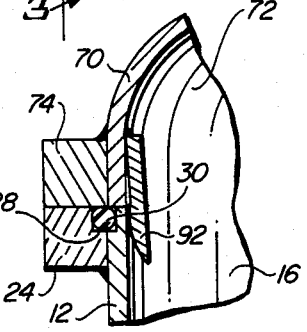
FIG. 6

PRESSURE CONTAINMENT VESSEL APPARATUS FOR LEAKING GAS CYLINDER

BACKGROUND OF THE INVENTION

1. Field of the Invention

This invention relates to pressure containment apparatus, and, more particularly, to cylindrical apparatus for containing a leaking cylinder out of which gas is leaking.

2. Description of the Prior Art

There are no known U.S. patents which disclose container apparatus designed to hold a leaking gas tank or cylinder until the tank or cylinder can be disposed of. However, there are several U.S. patents which disclose apparatus for sealing a leaking valve on a tank. In each patent, there are special elements associated with the valve or the tank that make the sealing of the valve itself possible. None of the elements associated with the sealing of the valve comprises a pressure vessel itself.

In U.S. Pat. No. 2,465,095 is disclosed a frame in which a tank having a leaking valve is placed. The frame includes elements for sealing the top portion of the tank.

U.S. Pat. No. 3,323,541 discloses apparatus with another type of sealing element for the top of a tank having a leaky valve. The sealing element cooperates with external threads at the base of the leaking valve.

U.S. Pat. No. 3,756,450 discloses apparatus for retaining a protective cap over a leaking valve of a tank. The apparatus does not appear to be designed to prevent leaking, but rather is designed to provide a protective housing for the valve.

The following four U.S. patents disclose apparatus designed to contain parts of a tank or pressure vessel that may explode. The various apparatus described in the patents contain fragments from the exploding tank, but do not contain the contents of the tank. They are primarily designed for nuclear pressurized reactor vessels. The patents include U.S. Pat. Nos. 3,910,447, 3,937,351, 3,963,565, and 3,970,208.

There are other U.S. patents which disclose apparatus for securing a top or dome to the bottom of a cylinder or other vessel designed to hold pressure. Examples of such patents include U.S. Pat. Nos. 1,384,915, 1,597,270, 1,894,652, and 1,900,627.

The U.S. Pat. No. 1,384,915 discloses a tank closure having a number of fixed studs that are engaged by hooked elements on a cap. The U.S. Pat. No. 1,597,270 discloses another type of hooked members which engage pivoting studs. The pivoting studs are secured to the tank. In the U.S. Pat. No. 1,894,652, pivoting studs are again used and are engaged by hooked elements. In the U.S. Pat. No. 1,900,627, in addition to fixed elements being secured to fixed studs, there is a safety retainer system that prevents rotation of the caps except when the nuts are completely loose. The tank top is prevented from turning when the top or dome is completely tightened against the tank. Thus, vibration could not cause the tank top to be rotated against the pressure of the nuts if the nuts were to inadvertently loosen to a slight degree.

SUMMARY OF THE INVENTION

The invention described and claimed herein comprises a cylinder adapted to receive another cylinder from which a pressurized gas is leaking. A closure for the containment cylinder is adapted to be secured to the pressure containment cylinder and to be sealed thereto to prevent the further leaking of pressurized gas from the inner, leaking cylinder. The cap or dome includes a valve for venting the leaking gas from the inner cylinder prior to the removal of the cap for the ultimate removal of the inner, leaking cylinder for disposal.

Among the objects of the present invention are the following:

To provide new and useful container apparatus;

To provide new and useful pressurized container apparatus;

To provide new and useful apparatus for containing a leaking gas cylinder;

To provide a new and useful apparatus for containing a leaking pressurized gas cylinder;

To provide new and useful apparatus into which a cylinder holding a pressurized gas may be inserted to prevent leaking from the pressurized cylinder prior to disposal; and To provide new and useful apparatus for containing a defective pressurized gas cylinder.

BRIEF DESCRIPTION OF THE DRAWING

FIG. 1 is a perspective view of the apparatus of the present invention.

FIG. 2 is an exploded perspective view of a portion of the apparatus of FIG. 1.

FIG. 4 is a bottom plan view of a portion of the apparatus of the present invention.

FIG. 5 is a top plan view of another portion of the apparatus of the present invention.

FIG. 6 is a view in partial section of a portion of the apparatus of FIG. 1, taken generally along line 6—6 of FIG. 1.

DESCRIPTION OF THE PREFERRED EMBODIMENT

Figure 3:
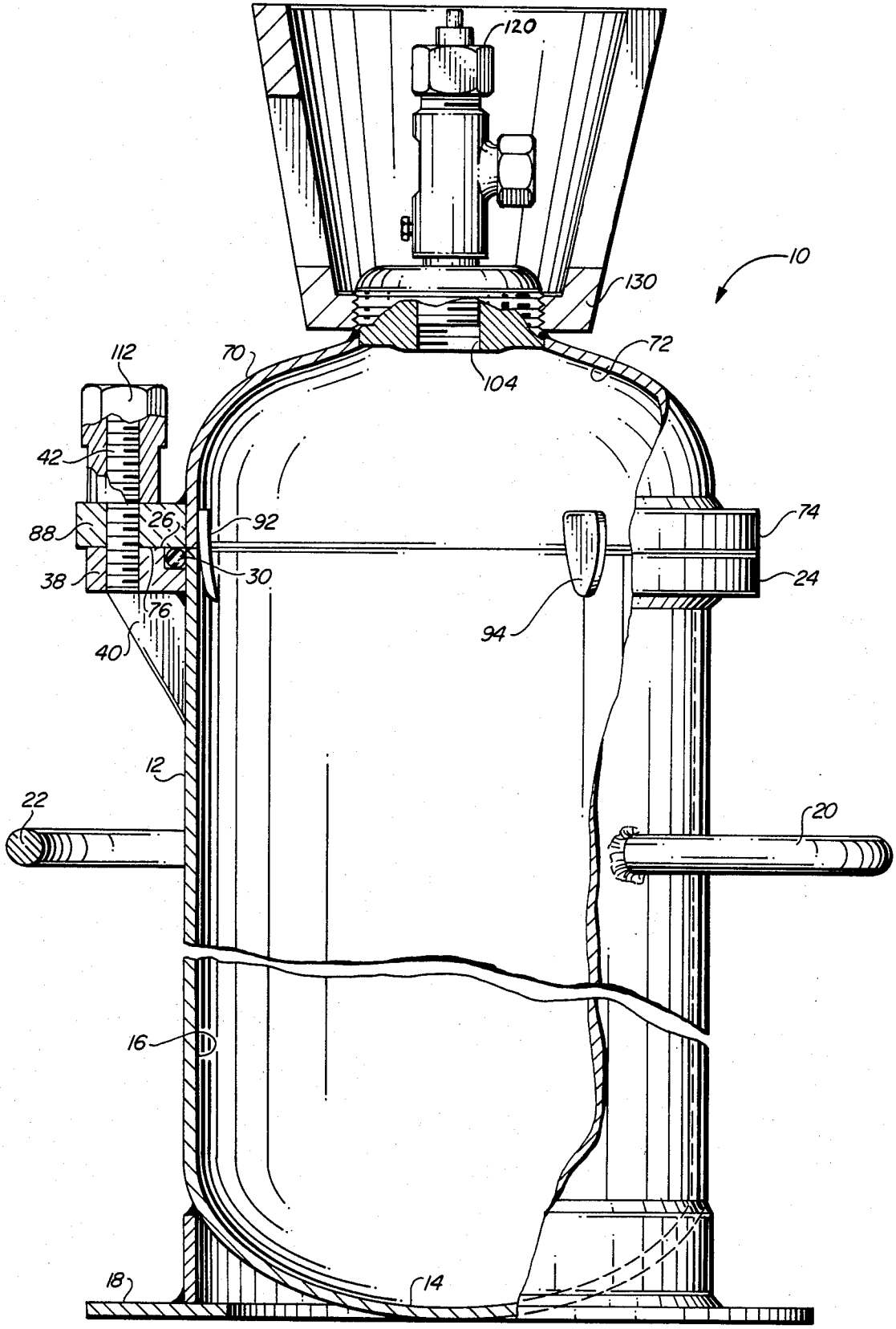
FIG. 3 is a view in partial section of the apparatus of FIG. 1, taken generally along line 3—3 of FIG. 1.

FIG. 1 is a perspective view of pressure containment apparatus 10 of the present invention. The container apparatus 10 includes a cylinder 12 and a cap 70 which is secured to the top or upper portion of the cylinder 12. FIG. 2 is an exploded perspective view of the upper portion of the cylinder 12, with the cap 70 spaced apart upwardly from the cylinder 12. FIG. 3 is a view in partial section of the assembled apparatus 10, with the cap 70 secured to the cylinder 12.

FIG. 4 is a plan view of the underside of the cap 70. FIG. 5 is a top plan view of the cylinder 12 looking downwardly into the cylinder. FIG. 6 is a view in partial section of the cylinder 12 and the cap 70, as secured together, and taken generally along line 6—6 of FIG. 1. For the following discussion, reference will be made to FIGS. 1, 2, 3, 4, 5, and 6.

The apparatus of the present invention comprises container apparatus 10 which is adapted to receive a pressurized container or vessel that is defective in some way and leaking the pressurized gas disposed therein. For example, pressurized cylinders filled with chlorine gas are in widespread use by swimming pool maintenance companies. A chlorine gas tank or cylinder is taken to a swimming pool and the water in the swimming pool is treated with the chlorine gas. If a leak develops in a chlorine gas cylinder, either as a result of a defective valve or as a result of a rupture of some type in the cylinder structure itself, a potentially hazardous situation occurs. The leaking chlorine gas should be contained as soon as possible to mitigate the potential damage. Moreover, the leaking cylinder must be removed to a safe area for disposal. The container apparatus 10 is adapted to receive such a leaking pressurized cylinder and to contain the leaking gas, and is adapted to be used to transport the leaking cylinder to a safe disposal area.

The container apparatus 10 includes a cylinder 12 which is, of course, in itself a tank designed to hold or to contain pressure. The cylinder 12 is closed by a rounded bottom 14. As is well known and understood in the art, a rounded bottom, such as the bottom 14, provides strength to the cylinder for containing a pressurized medium.

Within the cylinder is an interior bore 16. It is within the cylinder, in the bore 16, that a leaking, pressurized tank is adapted to be placed.

At the bottom of the cylinder 12 is a stand or base 18. The stand or base 18 is appropriately secured to the cylinder at the lower end or bottom of the cylinder, as by welding. The stand or base 18 includes an outwardly extending flange which allows the apparatus 10 to be free-standing.

At the top of the cylinder 12 is a flange 24 which includes a top surface 26. The top surface 26 defines a circular flat surface at the top of the flange and the cylinder wall. A circumferentially extending O-ring groove 28 extends downwardly into the top surface 26 of the cylinder 12. An O-ring 30 is disposed in the O-ring groove 28. The O-ring 30 acts as a sealing element for the apparatus 10. The O-ring 30 is compressed in the O-ring groove 28 when the cap 70 is placed on top of the flange 24 and thus seals the cap 70 and the cylinder 12.

Extending outwardly from the cylinder 12 is a pair of handles 20 and 22. The handles 20 and 22 are appropriately secured to the cylinder 12, as by welding. The handles facilitate the transporting of the apparatus 10.

The flange 24 includes three ears, including an ear 32, an ear 38, and an ear 44. The ears 32, 38, and 44 are spaced apart equal distances from each other on the flange 24. The ears extend outwardly from the flange. The ears are reinforced by gussets which extend between the ears and the tank. The gussets are also appropriately secured, as by welding, to both the cylinder 12 and the flange 24 and the respective ears. Two of the gussets, a gusset 34 and a gusset 40, are shown in FIGS. 1 and 2. The gusset 40 is also shown in FIG. 3. The gusset 34 extends between the cylinder 12 and the ear 32 and the flange 24, and the gusset 40 extends between the cylinder 12 and the flange 24 and the ear 38. The ear 44 also includes a gusset, but it is not shown in the drawing.

Each of the three ears includes an upwardly extending threaded stud. A threaded stud 36 is appropriately secured to the ear 32, a threaded stud 42 is appropriately secured to ear 38, and a threaded stud 48 is appropriately secured to the ear 44. The threaded studs 36, 42, and 48 extend upwardly from the top surface 26 of the flange 24 and its ears, and are used to secure the cap 70 to the cylinder 12. This will be discussed in detail below.

The cap 70 includes a dome 72. The dome 72 defines the upper wall for the cylinder apparatus 10 and comprises a continuation of the cylinder 12, as best shown in FIG. 3.

A radially outwardly extending flange 74 is disposed about the lower portion of the cap 70. The flange 74 includes a generally flat bottom surface 76. When the cap 70 is disposed on the cylinder 12, the generally flat or planar bottom surface 76 is disposed against the also generally flat and planar top surface 26 of the flange 24. The two flat surfaces 26 and 76, together with the O-ring 30 disposed in the groove 28, provide an appropriate seal for the cap 70 and the cylinder 12.

The flange 74 includes three relieved portions, including a relieved portion 78, a relieved portion 80, and a relieved portion 82. The relieved portions 78, 80, and 82 are indentations or cutout portions in the flange 74. They are equally spaced apart on the outer periphery of the flange 74. Their purpose will be discussed in detail below.

Also spaced apart equally, and extending outwardly from the outer periphery of the flange 74, are three arms or hooks, including an arm or hook 84, an arm or hook 86, and an arm or hook 88. The arms or hooks 84, 86, and 88 cooperate with the three studs 36, 42, and 48 to secure the cap 70 to the cylinder 12. The arms 84, 86, and 88 are disposed about the studs 36, 42, and 48 to lock the two elements together. As is best shown in FIG. 4, the relieved portions 78, 80, 82, and the arms 84, 86, and 88 are all spaced apart equally and are alternating with each other on the flange 74.

For purposes of alignment, that is, to appropriately and rapidly align the cap 70 with the cylinder 12, there are three alignment tabs secured to the interior of the cap 70. The tabs include a tab 90, a tab 92, and a tab 94. As also best shown in FIG. 4, the tabs are spaced apart equally or equidistant from each other. The tabs 90, 92, and 94 extend downwardly from the dome 72. This is best shown in FIGS. 3 and 6.

As will be understood, in order to hold various pressures, the cylinder 12 and the cap 70 are relatively heavy. For purposes of easily and rapidly securing the cap 70 to the cylinder 12, as after a leaking tank is disposed within the cylinder 12, the alignment tabs 90, 92, and 94 aid in quickly orienting the relatively heavy cap 70 properly with respect to the cylinder 12. The alignment tabs extend downwardly into the bore 16 of the cylinder 12 to help guide the cap 70 onto the top of the cylinder 12.

At the center top of the cap 70, and extending upwardly therefrom, is a boss 100. The boss 100 includes an externally threaded portion 102. The externally threaded portion 102 receives an appropriate valve shield 130, shown in FIG. 3, and which is well known in the art. The shield 130 is generally of a truncated conical configuration, inverted, with an internally threaded portion which receives the external threads 102. The shield extends upwardly and outwardly from the boss 100, and is disposed about a valve, such as a valve 120, also shown in FIG. 3.

Extending through the boss 100 is a centrally located internally threaded bore 104. The valve 120, which includes a lower externally threaded portion, appropriately extends into the internally threaded bore 102. The valve 120, as shown in FIG. 3, is of the type generally known as a Chlorine Institute Valve. It is a particular type of valve in contemporary use with pressurized containers or cylinders of chlorine.

For securing the cap 70 to the cylinder 12, there are three internally threaded nuts used. The nuts include a nut 110, a nut 112, and a nut 114.

In FIG. 1, the nut 110 is shown just on the stud 36, at the beginning of the threaded engagement between the nut 110 and the stud 36. The nut 112 and the nut 114 are shown in FIG. 1 as secured to their respective studs, and disposed against the arms of the cap 70.

The nuts 110, 112, and 114 include, obviously, a generally flat bottom surface adapted to make positive engagement against the upper surface of the three arms of the cap 70. The top surface of the arms, and also the top surface of the flange 74, is generally flat or planar, and is substantially parallel with the bottom surface 76. Thus, when the nuts are tightened down on the studs, and with the bottom surface 76 of the cap 72 disposed against the O-ring 30 and against the top surface 26 of the cylinder 12, a sealing engagement is made between the cap 70 and the cylinder 12.

With the cap 70 on the cylinder 12, a leaking pressurized cylinder or vessel disposed within the apparatus 10 is neutralized as far as leaking noxious or toxic gases is concerned. For disposal purposes, an appropriate connection may later be made with the valve 120 to allow the appropriate venting and disposal of gases leaked from the contained cylinder and into the interior of the apparatus 10. After such venting occurs, and the pressure within the apparatus 10 is balanced against the atmospheric pressure outside of the apparatus 10, the three nuts 110, 112, and 114 may then be loosened on their studs.

For simplifying the removal of the cap 70 from the cylinder 12, the nuts 110, 112, and 114 need not be completely removed from their studs. Rather, the nuts need only to be loosened a sufficient amount to relieve pressure against the arms of the cap. The cap 70 may then be rotated until the relieved portions or indentations 78, 80, and 82 of the cap are aligned with the studs and the nuts. The relieved portions 78, 80, and 82 are indented a sufficient distance to allow the vertical removal of the cap 70 without interference with the nuts 110, 112, and 114.

With the indentations 78, 80, and 82 aligned with the studs 36, 42, and 48, and their nuts 110, 112, and 114, the removal of the cap 70 is facilitated in order to expedite the removal of a leaking pressurized container disposed within the apparatus 10. In a similar manner, the installation of the cap 70 is expedited by aligning the indentations 78, 80, and 82 with the nuts 110, 112, and 114 which remain on their studs.

After the alignment of the indentations 78, 80, and 82 with the nuts and their studs, the cap 70 is installed. When the cap 70 is disposed on the cylinder 12, the cap is rotated clockwise, as may be understood from the drawing, one-sixth of a rotation, or about sixty degrees, until the arms 84, 86, and 88 are hooked about the studs 36, 42, and 48. The nuts 110, 112, and 114 are then tightened down to secure the cap 70 to the cylinder 12. The closure of the apparatus 10 is thus accomplished.

Both the installation and the removal of the cap 70 from the cylinder 12 are facilitated by the cooperation of the indentations in the flange 74 of the cap 70 with respect to the three studs 36, 42, and 48 and their nuts 110, 112, and 114. The arms and the indentations, being spaced apart equally, facilitate both the installation and removal of the cap 70. Obviously, if desired, the indentations or relieved portions and the arms may be located closer together so that the clockwise and counterclockwise movement or rotation of the cap during installation and removal of the cap may be expedited even more. However, generally speaking, it has been determined that equal spacing of the indentations and the arms helps to simplify the installation and removal of the cap. The symmetry of such an arrangement appears to aid in both installation and removal of the cap, and also in the equalizing of the forces acting on the flange 74 of the cap for stress purposes. Obviously, changes in dimensions and materials may also be a factor in the strength of the apparatus. Accordingly, utilizing material of various dimensions may make it desirable or advantageous, for some purposes, to have the relieved portions and the arms closer together, and thus not equally spaced apart, as illustrated herein.

While the principles of the invention have been made clear in illustrative embodiments, there will be immediately obvious to those skilled in the art many modifications of structure, arrangements, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Apparatus for containing a leaking pressurized cylinder, comprising, in combination:

cylinder means for receiving the leaking gas cylinder, including
- an outwardly extending first flange,
- a plurality of spaced apart ears on the first flange,
- a threaded stud on each ear, and
- a nut on each threaded stud; and cap means defining a closure for the cylinder means and adapted to be secured to the first flange of the cylinder means, including
- a dome,
- a second flange secured to the dome and adapted to be disposed on the first flange,
- a plurality of arms adapted to be disposed on and secured to the ears of the first flange by the studs and nuts, and
- a plurality of recesses adapted to allow the cap means to clear the nuts on the studs upon the loosening of the nuts from the arms and the rotating of the cap means to align the recesses with the studs and nuts to remove the cap means from the cylinder means.

2. The apparatus of claim 1 in which the cap means further includes valve means for venting gas leaking from the gas cylinder disposed within the apparatus and for providing atmospheric pressure within the apparatus in order to remove the cap means from the cylinder means.

3. The apparatus of claim 1 which further includes means for securing the cap means to the cylinder means in a pressure-tight relationship.

4. The apparatus of claim 1 in which the cap means further includes guide means for guiding the cap means onto the cylinder means, including a plurality of tabs extending downwardly from the dome and adapted to extend into the cylinder means.

5. The apparatus of claim 4 in which the plurality of tabs of the guide means are spaced apart from each other.

6. The apparatus of claim 5 in which the cylinder means further includes a cylinder in which the leaking gas cylinder is disposed, and a base secured to the cylinder and comprising a stand for allowing the cylinder to be free-standing.

7. The apparatus of claim 6 in which the cylinder means further includes handles secured to the cylinder for transporting the cylinder.

8. Apparatus for containing a leaking pressurized gas cylinder comprising, in combination:

cylinder means for receiving the leaking gas cylinder, including an outwardly extending first flange, a plurality of spaced apart ears on the first flange, a threaded stud on each ear, and a nut on each threaded stud;

cap means defining a closure for the cylinder means and adapted to be secured to the first flange of the cylinder means, including a dome, a second flange secured to the dome and adapted to be disposed on the first flange, a plurality of arms adapted to be disposed on and secured to the ears of the first flange by the studs and nuts, a plurality of recesses adapted to allow the cap means to clear the nuts on the studs upon the loosening of the nuts from the arms and the rotating of the cap means to align the recesses with the studs and nuts to remove the cap means from the cylinder means, and guide means for guiding the cap means into the cylinder means, including a plurality of tabs extending downwardly and adapted to extend into the cylinder means;

means for securing the cap means to the cylinder means in a pressure-tight relationship; and valve means for venting gas leaking from the gas cylinder disposed within the apparatus and for providing atmospheric pressure within the apparatus in order to remove the cap means.

9. The apparatus of claim 8 in which the valve means comprises a valve secured to the dome of the cap means.

10. The apparatus of claim 8 in which the plurality of tabs are spaced apart from each other and extend downwardly from the dome.

* * * * *